US009656791B2

(12) United States Patent
Yeh

(10) Patent No.: US 9,656,791 B2
(45) Date of Patent: May 23, 2017

(54) PACKAGING CUSHIONING MATERIAL

(71) Applicant: LI TAI GREEN PACKAGING CO., LTD., New Taipei (TW)

(72) Inventor: Ya-Ming Yeh, New Taipei (TW)

(73) Assignee: Li Tai Green Packaging Co., Ltd., New Taipei (TW)

( * ) Notice: Subject to any disclaimer, the term of this patent is extended or adjusted under 35 U.S.C. 154(b) by 0 days.

(21) Appl. No.: 14/955,449

(22) Filed: Dec. 1, 2015

(65) Prior Publication Data

US 2016/0159548 A1 Jun. 9, 2016

(30) Foreign Application Priority Data

Dec. 3, 2014 (TW) ..... 103221457 U
Mar. 6, 2015 (TW) ..... 104203334 U

(51) Int. Cl.
*B65D 81/05* (2006.01)
*B65D 81/02* (2006.01)

(52) U.S. Cl.
CPC ..... *B65D 81/022* (2013.01)

(58) Field of Classification Search
CPC ..... B65D 81/051; B65D 81/05; B65D 81/022
USPC ..... 206/523, 521, 586, 587
See application file for complete search history.

(56) References Cited

U.S. PATENT DOCUMENTS 3,992,810 A * 11/1976 Kimball ..... A01G 9/104 206/423
5,207,327 A * 5/1993 Brondos ..... B65D 5/509 206/521
7,398,884 B2 * 7/2008 Stegner ..... B65D 81/113 206/521
8,752,707 B2 * 6/2014 McDonald ..... 206/453

FOREIGN PATENT DOCUMENTS

TW 553185 U 9/2003

* cited by examiner

*Primary Examiner* — Steven A. Reynolds
(74) *Attorney, Agent, or Firm* — Muncy, Geissler, Olds & Lowe, P.C.

(57) ABSTRACT

A packaging cushioning material includes a connecting section, and a first assembly section and a second assembly section integrally extended from the connecting section. The first assembly section includes at least one first groove, at least one first assembly portion and a first clamping portion connected to the first assembly portion. The second assembly section includes at least one second groove, at least one second assembly portion disposed along an extension line of the first assembly portion, and a second clamping portion connected to the second assembly portion. By locking and fastening a fastening member at an assembly region, or by bending the first assembly section and the second assembly section towards the connecting section, the first clamping portion and the second clamping portion form a locking and fastening means to allow the packaging cushioning material to form a multilayer structure providing reduced transportation and storage complications.

3 Claims, 8 Drawing Sheets

PACKAGING CUSHIONING MATERIAL

FIELD OF THE INVENTION

The present invention relates to a cushioning material, and particularly to a cushioning material that forms a multilayer structure by a locking and fastening means.

BACKGROUND OF THE INVENTION

Along with the precision trend of technology products, in order to prevent damages caused by impacts during a transportation process of products, many manufacturers and industrialists adopt cushioning materials for preventing impacts during packaging and transportation processes. To further enhance the protection effect, many manufacturers and industrialists adopt cushioning materials that are in multilayer structures, and custom-make corresponding cushioning materials according to patterns of objects to be transported. However, as conventional cushioning materials are made by attaching a plurality of cushioning blocks, extremely precise alignment is required in the attaching process to ensure that the manufactured cushioning material is capable of reliably protecting the transported objects from impacts. As a result, the manufacturing process of the cushioning material is made too complicated.

In addition, after having been manufactured, a current cushioning material is a fixed pattern, which may result in storage difficulties and excessively occupy storage spaces. For example, the Taiwan Patent Publication No. 553185 discloses a design of box frame plates assembled by consecutively stacking hollow plates. The disclosed plate assembly is consisted of stacked frame plates and solid plates. The frame plate has hollow grooves or hollow holes, and holes, openings or grooves are provided at a periphery of the hollow groove or hollow hole. The solid plate is provided with holes, openings or grooves at corresponding positions. When the frame plate and the solid plate are stacked to form the plate assembly, the holes, openings or grooves form a symmetrical relationship for a detachable fastening element to bind, insert, screw or attach to become a box, a carton, a rack or a photo frame. In such method, a plurality of plates need to be individually folded to form the solid plate of a multilayer structure, and the detachable fastening element is then fastened. However, the fastening and alignment of the detachable fastening element may hinder the box frame plate from being readily and quickly assembled.

SUMMARY OF THE INVENTION

The primary object of the present invention is to solve the issue of a conventional complicated folding procedure.

To achieve the above object, the present invention provides a packaging cushioning material integrally formed from a cushioning material. The packaging cushioning material includes a connecting section, a first assembly section and a second assembly section. The first assembly section and the second assembly section are extended integrally from the connecting section, and each of the first assembly section and the second assembly section is connected to one side of the connecting section. The first assembly section includes at least one first assembly portion disposed at one side of the first assembly section away from the connecting section, and at least one first clamping portion connected to the first assembly portion. The second assembly section includes at least one second assembly portion disposed at one side of the second assembly section away from the connecting section, and at least one second clamping portion connected to the second assembly portion. The width of the first clamping portion is greater than the width of the first assembly portion, and the width of the second clamping portion is greater than the width of the second assembly portion. The first assembly section and the second assembly portion are turned towards the connecting section, such that the first assembly portion is locked and fastened in the second assembly portion, and the first clamping portion and the second clamping portion become fastened and locked, thereby allowing the packaging cushioning material to form a multilayer structure.

In one embodiment, the first assembly section includes at least one third assembly portion disposed at a distance from the first assembly portion, and at least one third clamping portion connected to each third assembly portion. The second assembly section includes a fourth assembly portion disposed along an extension line of the third assembly portion, and a fourth clamping portion connected to the fourth assembly portion. The width of the third clamping portion is greater than the width of the third assembly portion, and the width of the fourth clamping portion is greater than width of the fourth assembly portion.

In one embodiment, the first assembly portion and the third assembly portion have opposite configuration directions, and the second assembly portion and the fourth assembly portion have opposite configuration portions.

In one embodiment, the first assembly portion includes at least one first groove, and the second assembly portion includes at least one second groove. The first assembly section and the second assembly section are turned towards the connecting section to cause the first groove and the second groove to form an accommodating region.

The present invention further provides another embodiment in addition to the above embodiments. In the embodiment, the packaging cushioning material includes a cushioning body and at least one fastening member. The cushioning body includes a connecting section, and a first assembly section and a second assembly section connected to the connecting section. The first assembly section includes at least one first assembly portion disposed at one side of the first assembly section away from the connecting section, and a first clamping portion in communication with the first assembly portion. The second assembly section includes at least one second assembly portion disposed along an extension line of the first assembly portion, and a second clamping portion in communication with the second assembly portion. The width of the first clamping portion is greater than the width of the first assembly portion, and the width of the second clamping portion is greater than the width of the second assembly portion. The first assembly section and the second assembly section are turned towards the connecting section, such that the packaging cushioning material forms a multilayer structure, and the first assembly portion and the second assembly portion jointly form an assembly region. The fastening member is correspondingly locked and fastened at the assembly region, and includes an extension section, and a first fastening end and a second fastening end integrally extended from two sides of the extension section, respectively. The first fastening end and the second fastening end are fastened and locked in the first clamping portion and the second clamping portion, respectively, such that the first assembly section and the second assembly section are limited and become fixed.

In one embodiment, between the first fastening end and the second fastening end of the fastening member is an included angle ranging between 90 degrees and 180 degrees.

In one embodiment, the extension section of the fastening member includes a curvature.

In one embodiment, the cushioning body and the fastening member are a formed integral. The cushioning body includes a bridge section extended from the connecting section and connected to the fastening member. The first assembly section includes a first locking portion in communication with the first assembly portion, and the second assembly section includes a second locking portion in communication with the second assembly portion. The bridge section is bent and locked in first locking portion and the second locking portion.

In one embodiment, the cushioning body and the fastening member are a formed integral. The cushioning body includes a storage region that stores the fastening member, and is connected to the fastening member by a third bending line, such that the fastening member may be turned to stack on the connecting section and to be assembled in the assembly region.

In one embodiment, the first assembly section includes at least one first groove, and the second assembly section includes at least one second groove. The first assembly section and the second assembly section are turned towards the connecting section to cause the first groove and the second groove to form an accommodating region.

With the foregoing technical solutions, the present invention provides following advantages compared to the prior art.

First of all, in the present invention, the first assembly section and the second assembly section are turned towards the connecting section, such that the first assembly portion is locked and fastened in the second assembly portion, and the first clamping portion and the second clamping portion become locked and fastened with each other or become correspondingly locked and fastened at the assembly region using the fastening member, thereby allowing the packaging cushioning material to easily form a multilayer structure.

Secondly, the packaging cushioning material of the present invention includes a flat pattern when not in use. To put the present invention to use, the first assembly section and the second assembly section may be bent towards the extension section. As such, the first assembly portion and the first clamping portion may become locked and fastened with the second assembly portion and the second clamping portion, respectively, or the first clamping portion and the second clamping portion may become locked and fastened using the fastening member at the assembly region. Thus, the packaging cushioning material is allowed to form an application pattern in a multilayer structure, thereby solving the issue of complicated folding procedure of a conventional cushioning material.

DETAILED DESCRIPTION OF THE PREFERRED EMBODIMENTS

Figure 1:
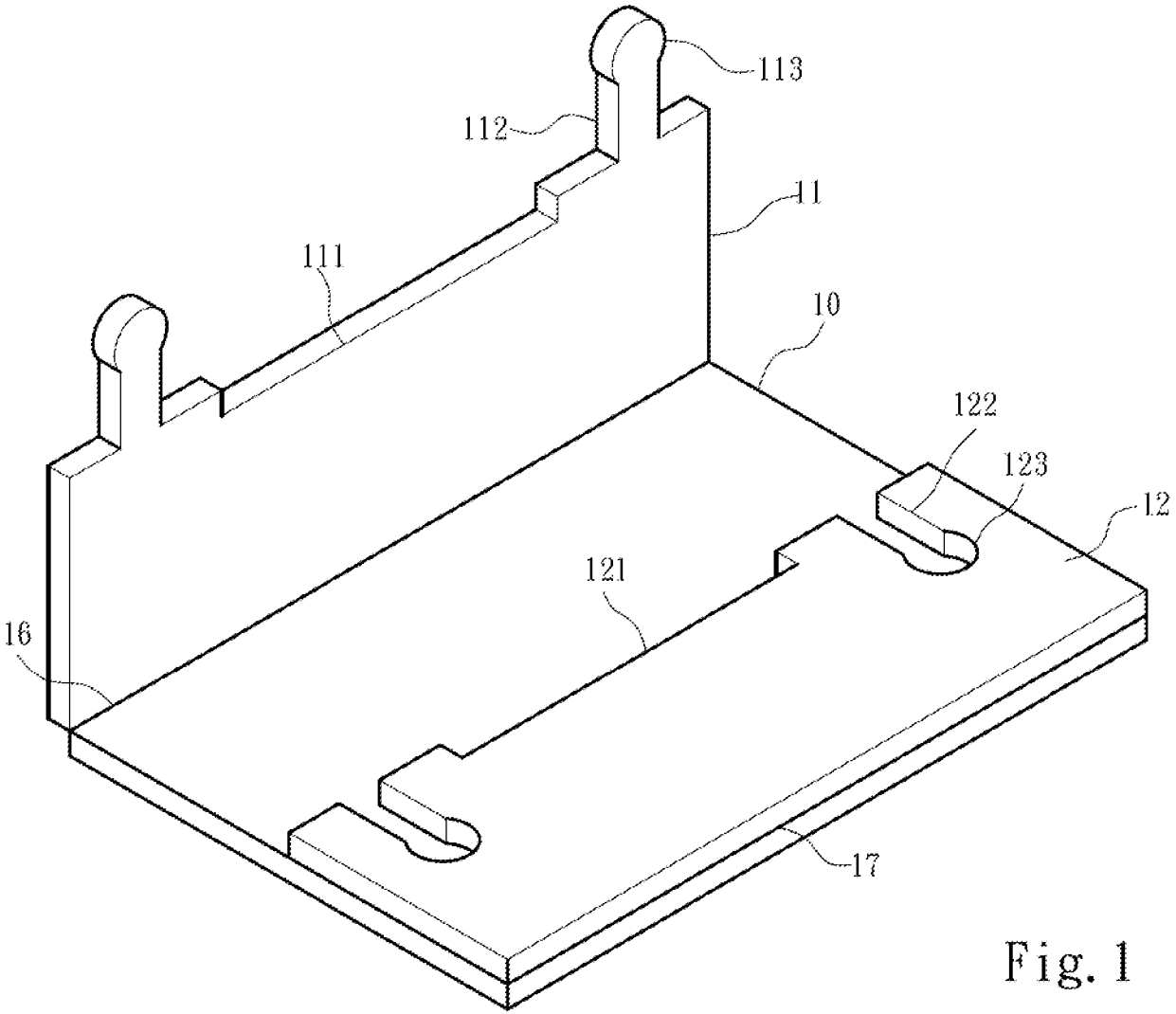
FIG. 1 shows a packaging cushioning material according to a first embodiment of the present invention.
Figure 2:
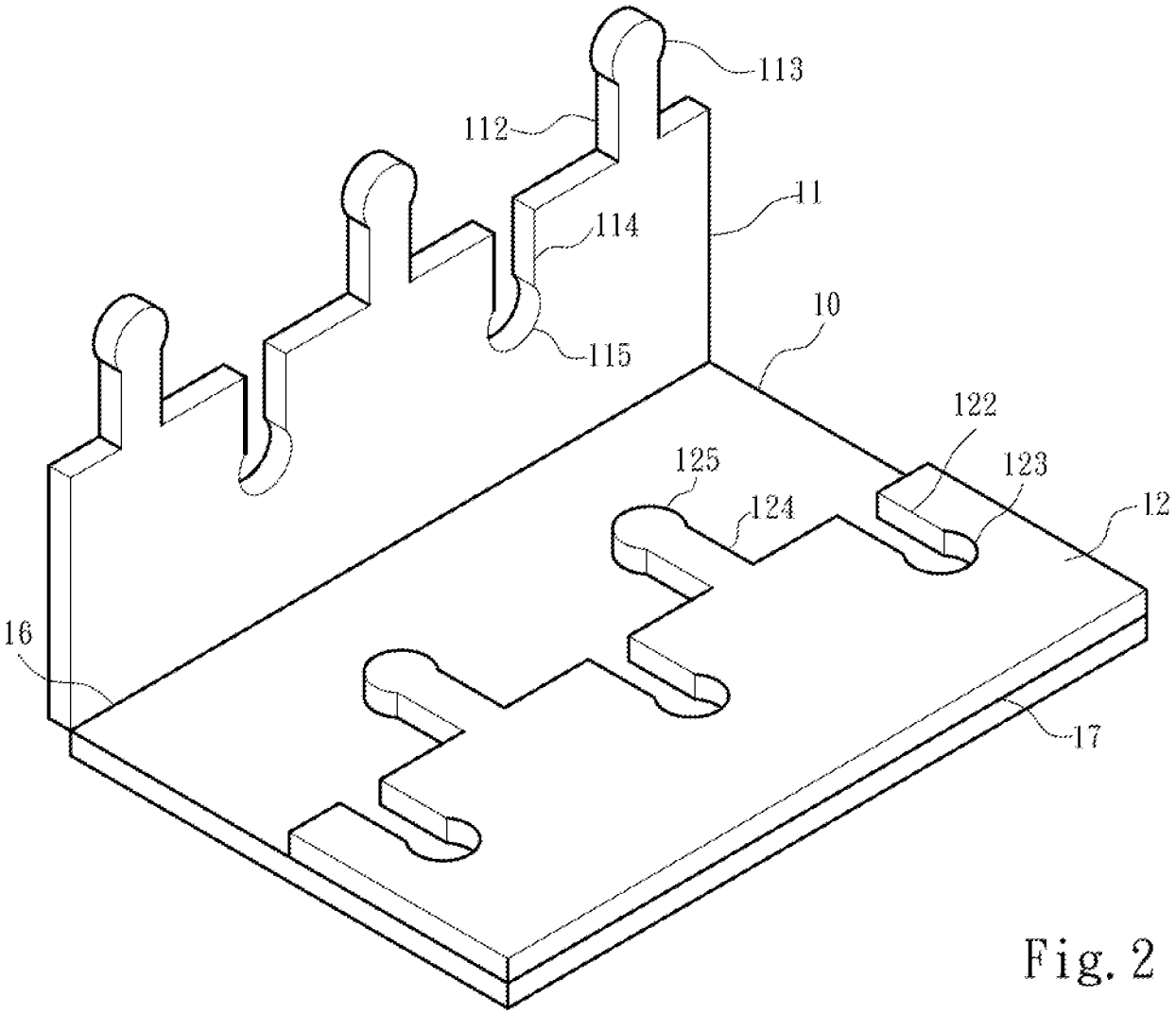
FIG. 2 shows a packaging cushioning material according to a second embodiment of the present invention.

Referring to FIG. 1 and FIG. 2, a packaging cushioning material of the present invention is an integral formed from a cushioning material, such as corrugated paper, a plastic material or other materials having appropriate rigidness. The packaging cushioning material includes a connecting section 10, a first assembly section 11 and a second assembly section 12. The first assembly section 11 and the second assembly section 12 are integrally extended from the connecting section 10 and are bendable towards the connecting section 10. In one embodiment, when the packaging cushioning material is being manufactured, a first bending line 16 and a second bending line 17 are configured as semi-detached. Further, the first bending line 16 is configured to locate between the connecting section 10 and the first assembly section 11, and the second bending line 17 is configured to locate between the connecting section 10 and the second assembly section 12. As such, the first assembly section 11 is allowed to bend along the first bending line 16 towards the connecting section 10 to overlap on the connecting section 10, and the second assembly section 12 is allowed to bend along the second bending line 17 towards the connecting section 10 to overlap on the connecting section 10.

At one side of the first assembly section 11 away from the connecting section 10, the first assembly section 11 includes at least one first assembly portion 112, and at least one first clamping portion 113 connected to the first assembly portion 112. At one side of the second assembly section 12 away from the connecting section 10, the second assembly section 12 includes at least one second assembly portion 122 disposed along an extension line of the first assembly portion 112, and at least one second clamping portion 123 connected to the second assembly portion 122. The width of the first clamping portion 113 is greater than the width of the first assembly portion 112, and the width of the second clamping portion 123 is greater than the width of the second assembly portion 122, thereby more securely locking and fastening the first clamping portion 113 and the second clamping portion 123. Further, at one side of the first assembly section 11 provided with the first assembly portion 112, the first assembly section 11 includes a first groove 111; at one side of the second assembly section 12 provided with the second assembly portion 122, the second assembly section 12 includes a second groove 121. After the first assembly section 11 and the second assembly section 12 are turned towards the connecting section 10, the first groove 111 and the second groove 121 jointly form an accommodating region 13. The accommodating region 13 is for accommodating an object therein to provide a cushioning effect, so as to reduce the probability of impacting and damaging the object during a transportation process.

Referring to FIG. 1 and FIG. 2, an assembly process of the packaging cushioning material is given in detail below. At the beginning of the assembly process, the connecting section 10, the first assembly section 11 and the second assembly section 12 are in flat patterns. A user may simultaneously or sequentially bend the first assembly section 11 and the second assembly section 12. Sequentially bending the first assembly section 11 and the second assembly section 12 is given as an example for illustrations. The user first bends the first assembly section 11 along the first bending line 16 towards the connecting section 10 to overlap the first assembly section 11 on the connecting section 10. The user then bends the second assembly section 12 along the second bending line 17 towards the connecting section 10 to overlap the second assembly section 12 on the connecting section 10. The user eventually locks and fastens each second assembly portion 122 with each first assembly portion 112, such that each second clamping portion 123 locks and fastens each first clamping portion 113 to form the packaging cushioning material in a multilayer structure.

As shown in FIG. 2, the first assembly section 11 includes at least one third assembly portion 114 having an opposite configuration direction from that of the first assembly portion 112, and at least one third clamping portion 115 connected to the third assembly portion 114. The second assembly section 12 includes at least one fourth assembly portion 124 disposed along an extension line of the third assembly portion 114 and having an opposite configuration direction from that of the second assembly portion 122, and at least one fourth clamping portion 125 connected to the fourth assembly portion 124. Further, the width of the third clamping portion 115 is greater than the width of the third assembly portion 114, and the width of the fourth clamping portion 125 is greater than the fourth assembly portion 124, thereby more securely locking and fastening the third clamping portion 115 with the fourth clamping portion 125. At the beginning of the assembly process, the connecting section 10, the first assembly section 11 and the second assembly section 12 are in flat patterns. The user may simultaneously or sequentially bend the first assembly section 11 and the second assembly section 12. To sequentially bend the first assembly section 11 and the second assembly section 12, the user may first bend the first assembly section 11 along the first bending line 16 towards the connecting section 10 to overlap the first assembly section 11 on the connecting section 10, and then bend the second assembly section 12 along the second bending line 17 towards the connecting section 10 to overlap the second assembly section 12 on the connecting section 10. The user eventually locks and fastens each second assembly portion 122 of the second assembly section 12 with each first assembly portion 112 of the first assembly section 11, each second clamping portion 123 of the second assembly section 12 with each first clamping portion 113 of the first assembly section 11, each fourth assembly portion 124 of the second assembly section 12 with each third assembly portion 114 with the first assembly section 11, and each fourth clamping portion 125 of the second assembly section 12 with each third clamping portion 115 of the first assembly section 11, thereby forming the packaging cushioning material in a multilayer structure.

Figure 3:
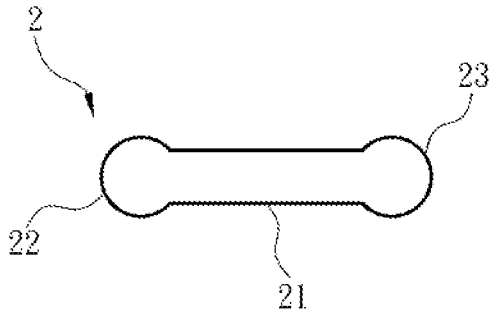
FIG. 3 is a schematic diagram of a fastening member according to the first embodiment of the present invention.
Figure 4:
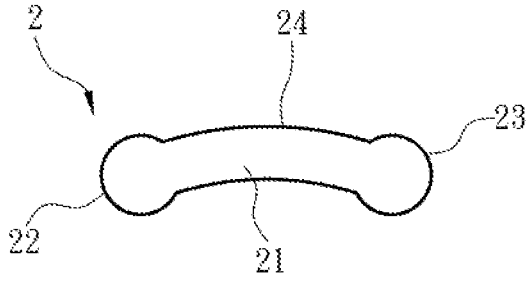
FIG. 4 is a schematic diagram of a fastening member according to the second embodiment of the present invention.
Figure 5:
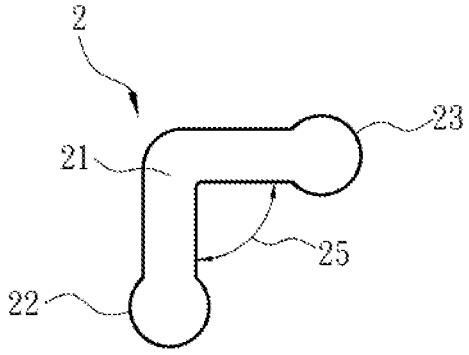
FIG. 5 is a schematic diagram of a fastening member according to a third embodiment of the present invention.
Figure 7:
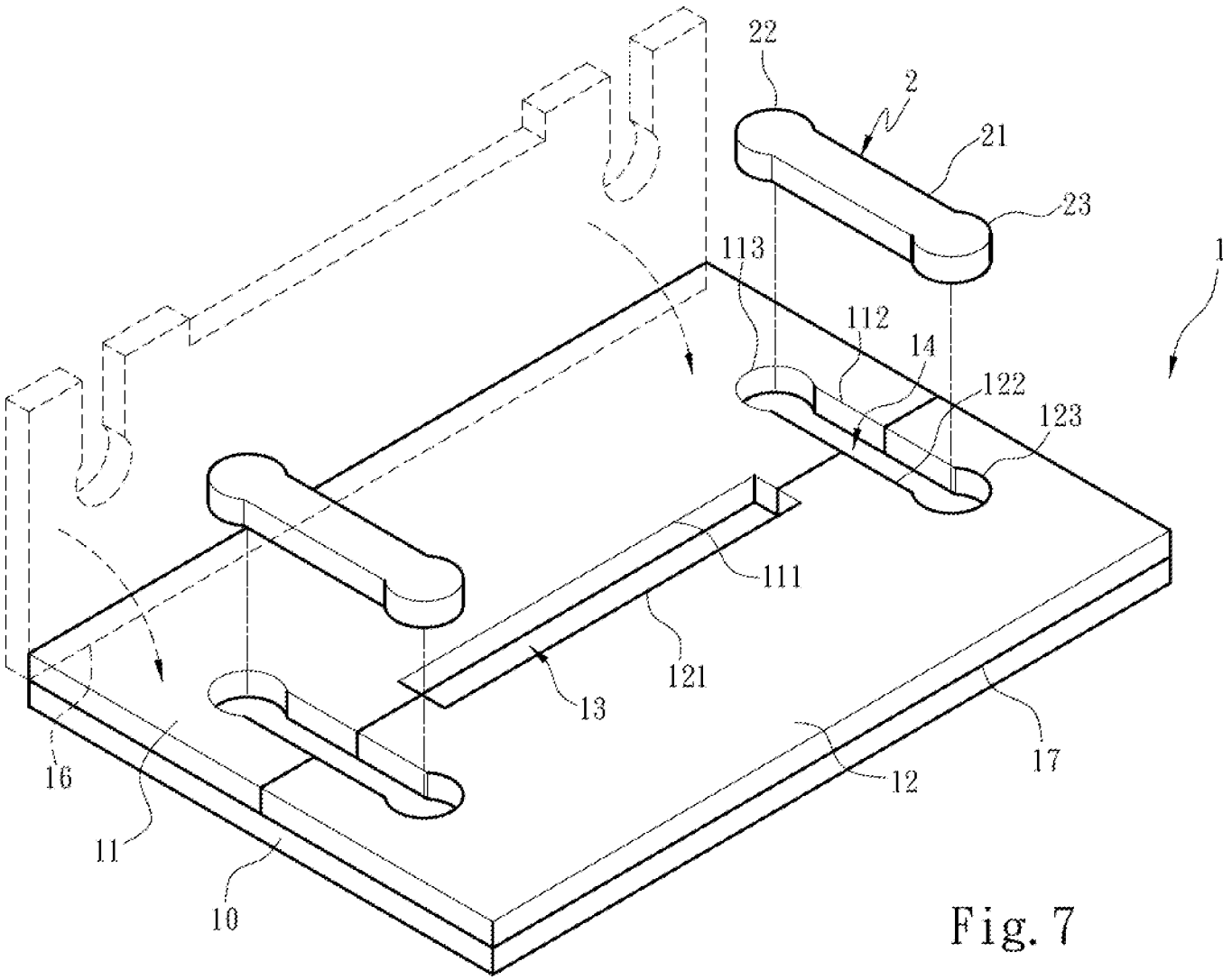
FIG. 7 shows a packaging cushioning material according to a fourth embodiment of the present invention.

In addition to the above embodiments, in another embodiment of the present invention, the packaging cushioning material may be implemented by a cushioning body 1 coordinating with a fastening member 2. The cushioning body 1 is a formed integral including the connecting section 10, the first assembly section 11 and the second assembly section 12. Each of the first assembly portion 112 and the second assembly portion 122 may be a recess. When the first assembly section 11 and the second assembly section 12 are bent towards the connecting section 10, the first assembly portion 112 and the second assembly portion 122 jointly form an assembly region 14, as shown in FIG. 7. Further, the fastening member 2 of the present invention may be disposed in the assembly region 14, and may be made of the same cushioning material or plastic material as the cushioning body 1. More specifically, the fastening member 2 includes an extension section 21, a first fastening end 22 and a second fastening end 23. The first fastening end 22 and the second fastening end 23 are integrally extended from two ends of the extension section 21, respectively. The extension section 21 of the fastening member 2 includes a curvature 24, such that the fastening member 2 displays an arched pattern. In another embodiment, between the first fastening end 22 and the second fastening end 23 of the fastening member 2 is an included angle 25. The assembly region 14 is adjusted according to the implementation pattern or assembly requirements of the fastening member 2. The included angle 25 may be any angle between 90 degrees and 180 degrees. the fastening member 2 may a rectangular pattern as shown in FIG. 3, an arched pattern as shown in FIG. 4, or a right-angled pattern as shown in FIG. 5. When the fastening member 2 is installed, the first fastening end 22 is locked and fastened in the first clamping portion 113, and the second fastening end 23 is locked and fastened in the second clamping portion 123. To securely fasten the fastening member 2, the widths of the first fastening end 22 and the second fastening end 23 of the fastening member 2 are greater than the width of the extension section 21, the width of the first clamping portion 113 is greater than the width of the first assembly portion 112 of the first assembly section 11, and the width of the second clamping portion 123 is greater than the second assembly portion 122 of the second assembly section 12. As such, the first fastening end 22 and the second fastening end 23 may be more securely locked and fastened in the first clamping portion 113 and the second clamping portion 123, respectively. Further, according to application requirements, the first groove 111 and the second groove 121 may be disposed at the sides of the first assembly section 11 and the second assembly section 12. Thus, when the first assembly section 11 and the second assembly section 12 are bent towards the connecting section 10, the first groove 111 and the second groove 121 jointly define the accommodating region 13 for accommodating an object.

Figure 10:
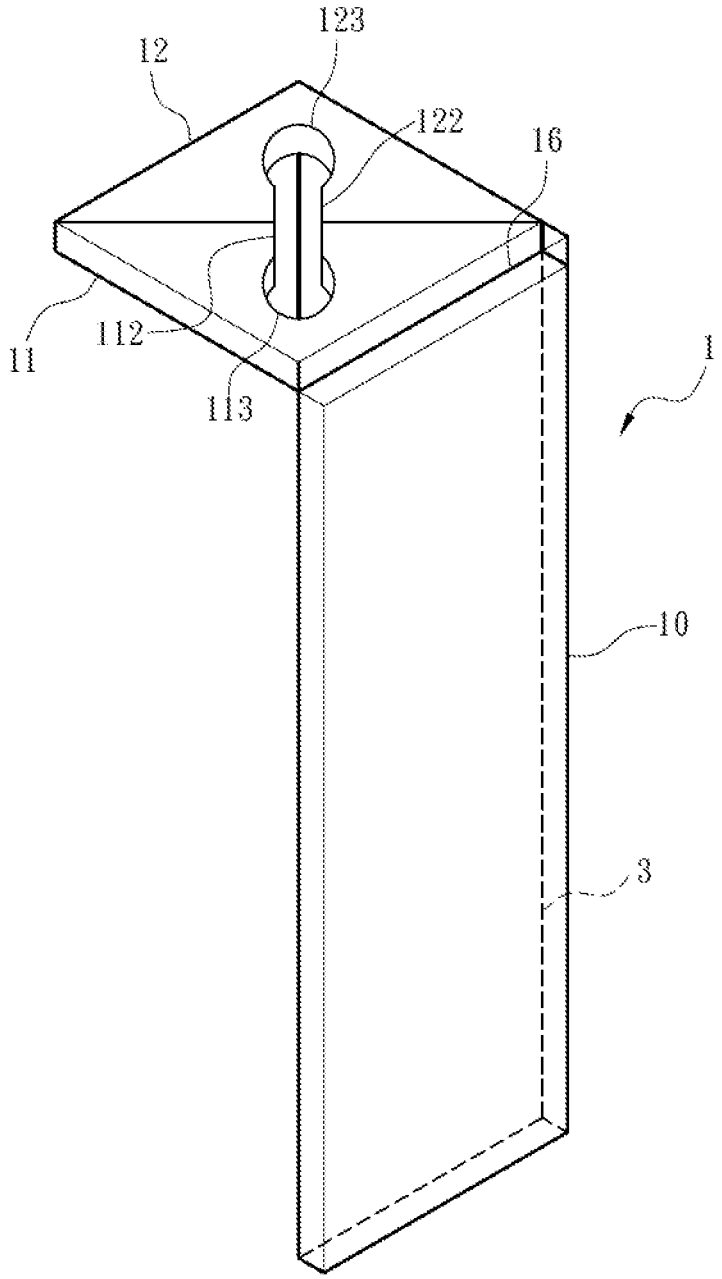
FIG. 10 shows a packaging cushioning material according to a seventh embodiment of the present invention.

Referring to FIG. 10, the first assembly section 11 and the second assembly section 12 are disposed at the same side of the connecting section 10. The connecting section 10 includes a fourth bending line 3. When the first assembly section 11 and the second assembly section 12 are respectively bent along the first bending line 16 and the second bending line 17 towards the connecting section 10, the connecting section 10 is further bent along the fourth bending line 3 to cause the first assembly section 11 and the second assembly section 12 to come into contact with each other. Thus, the first assembly portion 112 of the first assembly section 11 and the second assembly portion 122 of the second assembly section 12 jointly form the assembly region 14 for locking and fastening the fastening member 2.

Figure 6:
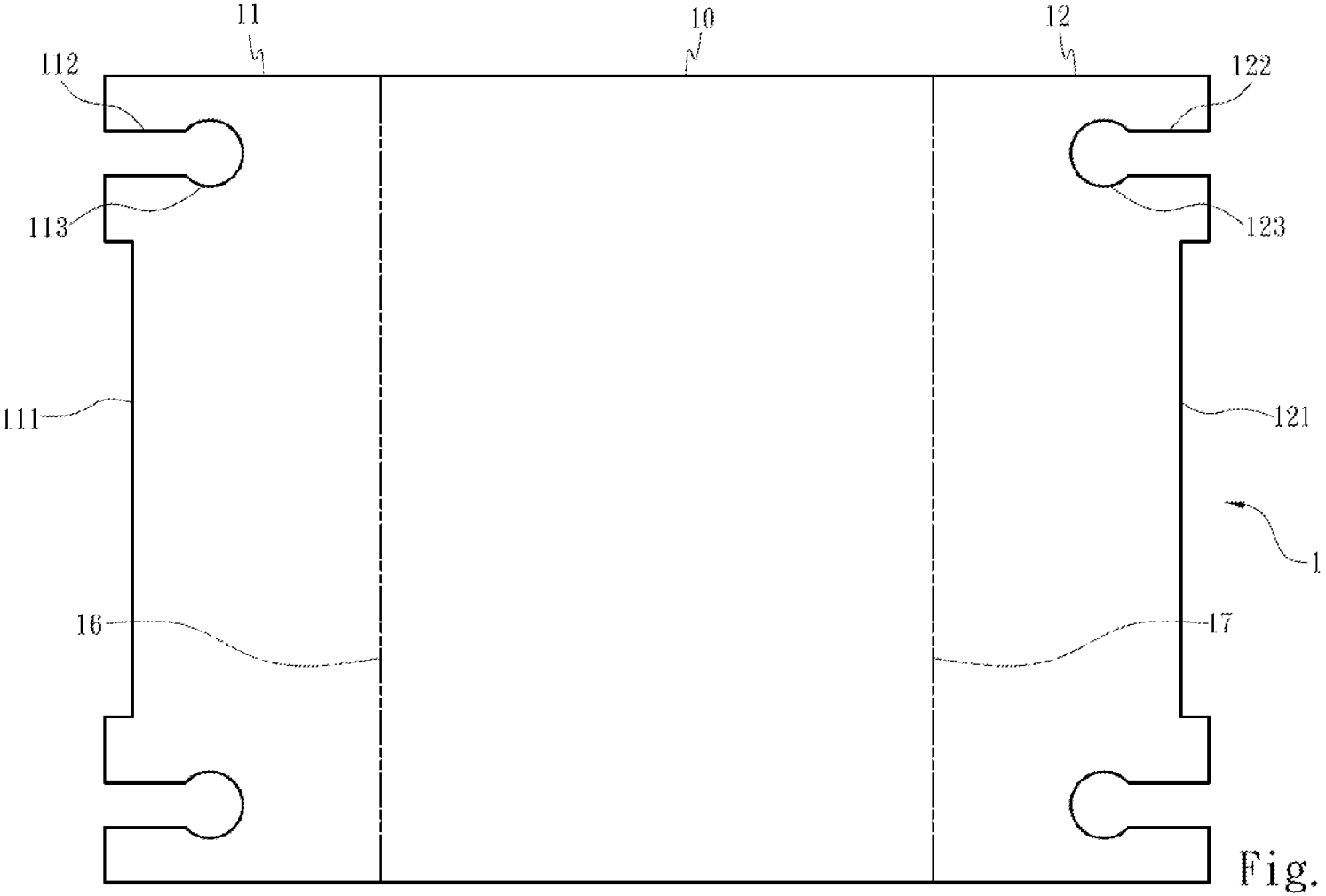
FIG. 6 shows a packaging cushioning material according to the third embodiment of the present invention.

Again referring to FIG. 6 to FIG. 9, the assembly process according to this embodiment is given in detail below. As shown in FIG. 6 and FIG. 7, at the beginning of the assembly process, the cushioning body 1 is in a flat pattern. The user may simultaneously bend the first assembly section 11 and the second assembly section 12, in a way that the first assembly section 11 is bent along the first bending line 16 towards the connecting section 10 to overlap the first assembly section 11 on the connecting section 10, and the second assembly section 12 is bent along the second bending line 17 towards the connecting section 10 to overlap the second assembly section 12 on the connecting section 10. Thus, the first assembly portion 112 and the second assembly portion 122 form the assembly region 14. The user may then lock and fasten the extension section 21 in the assembly region 14 to lock and fasten the first fastening end 22 in the first clamping portion 113 and to lock and fasten the second fastening end 23 in the second clamping portion 123, thereby forming the packaging cushioning material in a multilayer structure.

Figure 8:
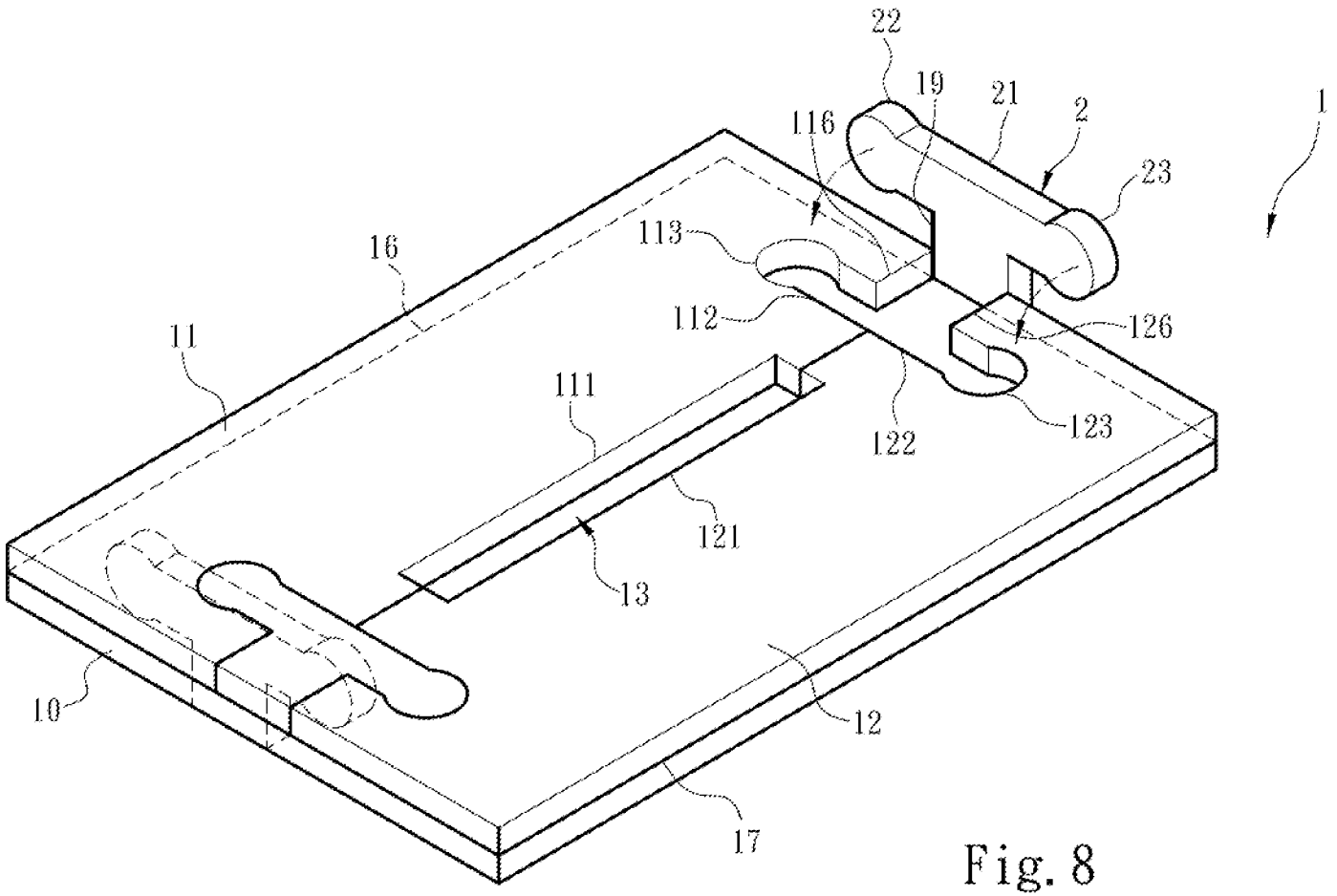
FIG. 8 shows a packaging cushioning material according to a fifth embodiment of the present invention.

As shown in FIG. 8, the cushioning body 1 and the fastening member 2 are a formed integral. The cushioning body 1 includes a bridge section 19, which is extended from the connecting section 10 and connected to the fastening member 2. The first assembly section 11 includes a first locking portion 116 connected to the first assembly portion 112, and the second assembly section 12 includes a second locking portion 126 connected to the second assembly portion 122. When the first assembly section 11 and the second assembly section 12 are bent towards the connecting section 10, the fastening member 2 and the bridge section 19 are bent towards the connecting section 10, in a way that the bridge section 19 is locked in the first locking portion 116 and the second locking portion 126, and the fastening member 2 is locked in the assembly region 14, the first clamping portion 113 and the second clamping portion 123. At the beginning of the assembly process, the cushioning body 1 is in a flat pattern. The user may simultaneously bend the first assembly section 11 and the second assembly section 12, in a way that the first assembly section 11 is bent along the first bending line 16 towards the connecting section 10 to overlap the first assembly section 11 on the connecting section 10, and the second assembly section 12 is bent along the second bending line 17 towards the connecting section 10 to overlap the second assembly section 12 on the connecting section. Thus, the first assembly portion 112 and the second assembly portion 122 form the assembly region 14. The user may then bend the bridge section 19 and the fastening member 2 towards the connecting section 10 to lock and fasten the bridge section 19 in the first locking portion 116 and the second locking portion 126, and to lock and fasten the second fastening end 23 in the second clamping portion 123, thereby forming the packaging cushioning material in a multilayer structure.

Figure 9:
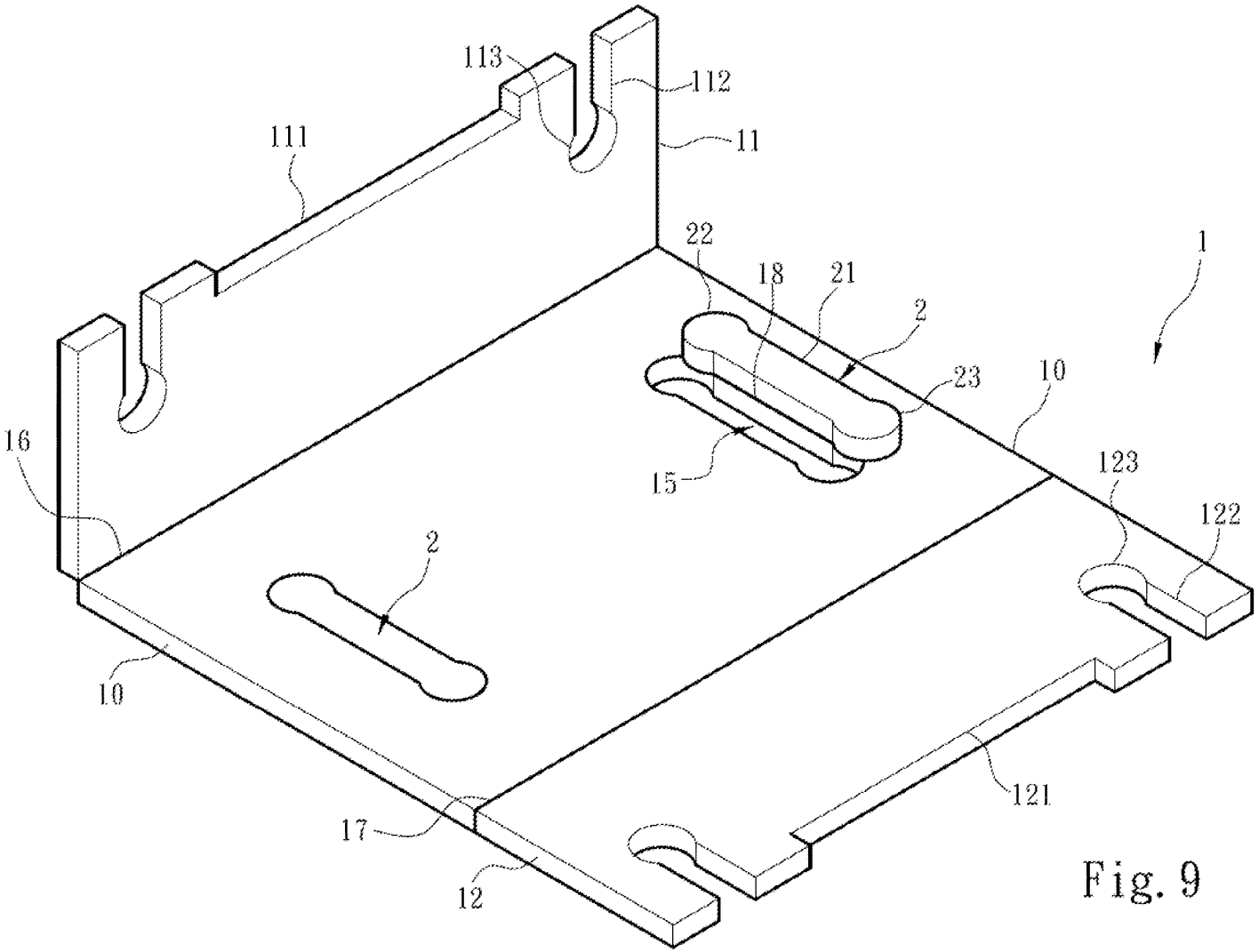
FIG. 9 shows a packaging cushioning material according to a sixth embodiment of the present invention.

As shown in FIG. 9, when the cushioning body 1 is being manufactured, a cutting device is placed on the connecting section 10 to cut out a contour of the fastening member 2, and one edge between the fastening member 2 and the connecting section 10 is designed as semi-detached to produce a third bending line 18. The fastening member 2 is allowed to bend along the third bending line 18 to overlap on the connecting section 10. Further, the connecting section 10 is formed at the position of the fastening member 2 to form a storage region 15, which may store the fastening member 2 when the fastening member 2 is not in use. At the beginning of the assembly process, the cushioning body 1 is in a flat pattern. The user may first bend the fastening member 2 along the third bending line 18 to overlap the fastening member 2 on the connecting section 10. The user may then simultaneously bend the first assembly section 11 and the second assembly section 12, in a way that the first assembly section 11 is bent along the first bending line 16 towards the connecting section 10 to overlap the first assembly section 11 on the connecting section 10, and the second assembly section 12 is bent along the second bending line 17 towards the connecting section 10 to overlap the second assembly section 12 on the connecting section 10. In the overlapping process, the user may eventually lock and fasten the first assembly portion 112, the first clamping portion 113, the second assembly portion 122 and the second clamping portion 123 in the fastening member 2, thereby forming the packaging cushioning material having a multilayer structure.

What is claimed is:

1. A packaging cushioning material, being an integral formed from a cushioning material, the packaging cushioning material comprising:

a connecting section; and a first assembly section and a second assembly section, integrally extended from the connecting section, wherein a first bending line is configured to locate between the connecting section and the first assembly section, a second bending line is configured to locate between the connecting section and the second assembly section, each of the first assembly section and the second assembly section being connected to one side of the connecting section, the first assembly section comprises at least one first assembly portion disposed at one side of the first assembly section away from the connecting section, at least one first clamping portion connected to the first assembly portion, and at least one first groove disposed away from the first bending line, the second assembly section comprises at least one second assembly portion disposed at one side of the second assembly section away from the connecting section, and at least one second clamping portion connected to the second assembly portion, and at least one second groove disposed away from the second bending line, the width of the first clamping portion is greater than the width of the first assembly portion, the width of the second clamping portion is greater than the width of the second assembly portion;

wherein, the first assembly section and the second assembly section are bent towards the connecting section, such that the first assembly portion is locked and fastened in the second assembly portion and the first clamping portion is locked and fastened in the second clamping portion to cause the first groove and the second groove jointly form an accommodating region and form the packaging cushioning material in a multilayer structure.

2. The packaging cushioning material of claim 1, wherein the first assembly section comprises at least one third assembly portion disposed at a distance from the first assembly portion and at least one third clamping portion connected to the third assembly portion; the second assembly section comprises a fourth assembly portion disposed along an extension line of the third assembly portion and a fourth clamping portion connected to the fourth assembly portion, the width of the third clamping portion is greater than the width of the third assembly portion, and the width of the fourth clamping portion is greater than the width of the fourth assembly portion.

3. The packaging cushioning material of claim 2, wherein the first assembly portion and the third assembly portion have opposite configuration directions, and the second assembly portion and the fourth assembly portion have opposite configuration directions.

* * * * *